United States Patent [19]

Flaig et al.

[11] 4,282,593

[45] Aug. 4, 1981

[54] ELECTRONIC CLOCK CIRCUITRY FOR A CLOCK HAVING CHIMES OR AN ALARM

[75] Inventors: Hans Flaig, Schramberg; Jurgen Allgaier, Lauterback; Friedrich Assmus, Schramberg, all of Fed. Rep. of Germany

[73] Assignee: Gebruder Junghans, GmbH, Schramberg, Fed. Rep. of Germany

[21] Appl. No.: 39,135

[22] Filed: May 15, 1979

[30] Foreign Application Priority Data

May 18, 1978 [DE] Fed. Rep. of Germany ..... 2821660

[51] Int. Cl.[3] ..... G04B 21/08; G04C 21/14

[52] U.S. Cl. ..... 368/63; 368/273

[58] Field of Search ..... 58/12, 13, 38 R, 38 A, 58/57.5, 152 R, 152 A; 340/384 E; 364/705; 368/75, 251, 272, 273, 63, 274

[56] References Cited

U.S. PATENT DOCUMENTS

| | | | |
|---|---|---|---|
| 3,999,050 | 12/1976 | Pitroda | 340/172.5 |
| 4,060,973 | 12/1977 | Martino | 368/245 |
| 4,090,349 | 5/1978 | Takase | 340/384 E |
| 4,172,359 | 10/1979 | Gorsky et al. | 368/273 |

*Primary Examiner*—Vit W. Miska

*Attorney, Agent, or Firm*—Burns, Doane, Swecker & Mathis

[57] ABSTRACT

A time-controlled tone signal is produced by electronic clock circuitry for a clock having chimes and/or an alarm system. In order to provide fully electronic storage and release of tone signal sequences, their data, such as tone frequencies and tone lengths, are stored in digital form in a memory circuit. The data is recalled from the memory with regard to time and is transformed by means of an electro-acoustic transducer into the desired sequence of tone signals.

9 Claims, 5 Drawing Figures

17
1
2
3
4
5
6
7
8
9
10
11
12
13
14
15
16
18
19
20
21
22
23
24
25
26
27
28
29
30
31
32
33
34
35
36
37

ELECTRONIC CLOCK CIRCUITRY FOR A CLOCK HAVING CHIMES OR AN ALARM

BACKGROUND OF THE INVENTION

The present invention relates to electronic clock circuitry for a clock having chimes or an alarm system, or both, for the production of a sequence of tone signals.

Clocks with chimes produce sequences of acoustic tone signals every quarter, half, three quarter and full hour. These acoustic signals can be individual single tones or short melodic sequences. The tone signals are generally produced by mechanical means. Electric alarm clocks produce a tone signal by means of a separate generator at specifically set times. Musical alarm clocks can also turn on a program of a radio station by activating a radio at a specifically set time.

A number of different electronic clock circuits are known which are formed as integrated circuit chips (see for example H. Bernstein's article "Beispiele integrierter Schaltungen," at pages 122 and following). These known electronic clock circuits are not suitable for the storage and production of tone signal sequences, for example short melodies. At best, they include a switchable output terminal which can be connected to a separate tone generator.

It is an object of the present invention to provide an electronic clock circuit which is suitable for the storage and production of tone signal sequences, such as strokes or short melodies produced on the hour.

The present invention achieves this objective by providing a novel clock circuit in which data pertaining to at least one sequence of tone signals, such as tone frequencies and tone lengths, is stored in digital form in a memory circuit. The data pertaining to the sequence of tone signals, or pertaining to individual sequences of tone signals, is recalled from the memory circuit at a certain time, and the recalled data is translated into the desired tone signals by means of an electroacoustic transducer, such as a loudspeaker. Depending on the storage capability available with the memory circuit being utilized and the amount of data for the tone signal sequence to be stored, it is possible to store one or more sequences of tone signals which can be recalled at various designated moments in time, or at any other desired time.

In a further aspect of the present invention, the recall of the data relating to a tone signal sequence can be accomplished by means of a switch which is controlled by the clockwork mechanism of the clock. In another development of the present invention, a time counting circuit can be incorporated in the clock circuit, and this circuit can be programmed to recall the stored data at a specific moment in time. The clock circuitry can be assembled with microprocessor and memory modules which are well known. Such integrated circuit systems are commercially available and are described, for example, in the publications by Werner DIEHL, "Mikroprozessoren and Mikrocomputer," Wuerzburg, 1977 and by H. PELKA, "Von der Schaltalgebra zum Mikroprozessor," Muenchen, 1977.

In a further development of the present invention, a sound producing network, such as a resonant circuit, is placed in series with the electroacoustic transducer, thus making it possible to influence the sound of the tone signal sequence.

The electronic clock circuitry proposed by the invention can be used in connection with various modes and conditions. The clock circuitry provides a clock with chimes or an alarm system where the form of the tone signal sequences can be programmed. It is further possible in cases where a date function is present to produce a special tone signal sequence for a specific date.

Additional advantageous developments of the invention will become apparent from the description given below.

DETAILED DESCRIPTION OF THE PREFERRED EMBODIMENTS

Figures 1, 1A, 1B:
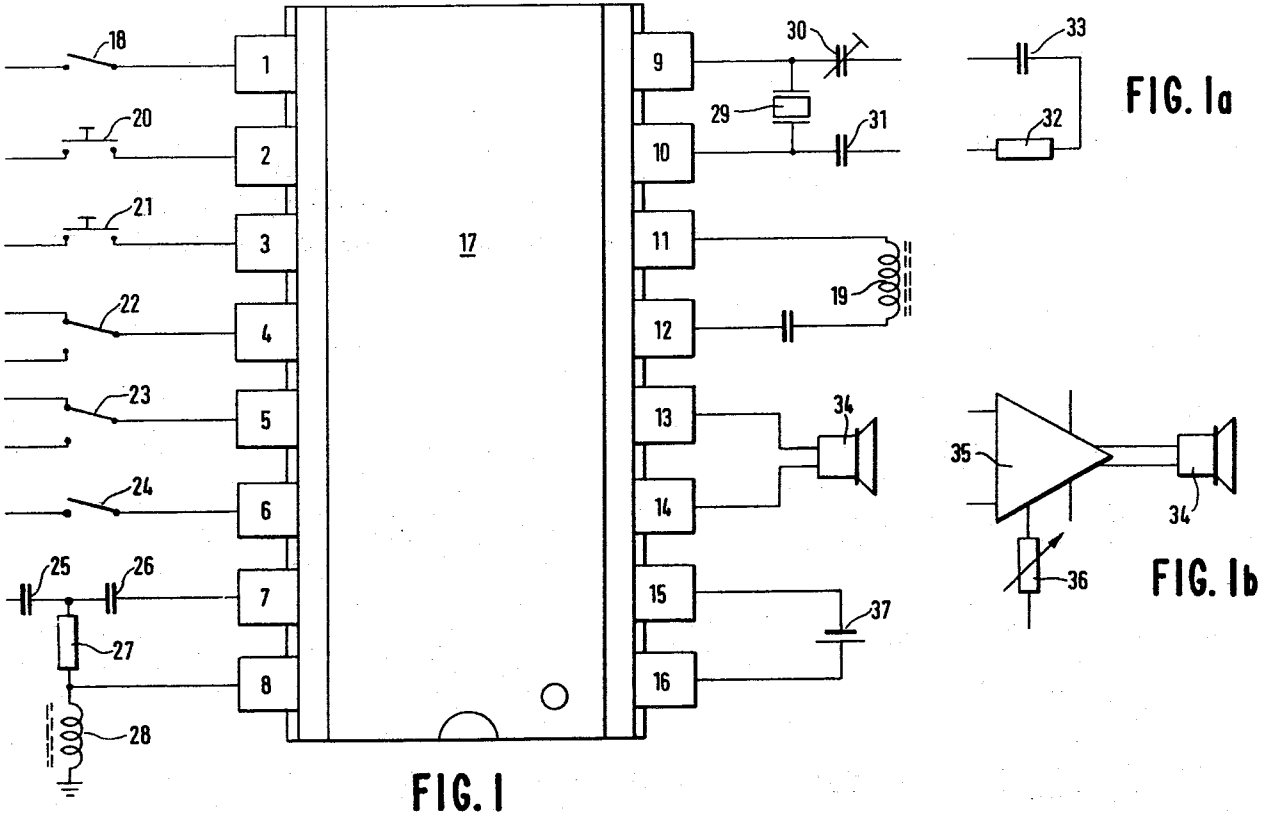
FIG. 1 is a schematic circuit diagram of a clock circuitry with an integrated circuit system.
FIGS. 1*a* and 1*b* illustrate alternative embodiments for an oscillator and a loudspeaker drive circuit, respectively.

The clock circuitry shown in FIG. 1 consists of one single module or integrated circuit chip 17 with terminals 1 to 16, into which are integrated in a known manner a microprocessor, a read-only memory (ROM), a random access memory (RAM) and an input-output chip. In the (ROM and RAM) memories is stored data for the tone frequencies, tone lengths, data flow and input/output functions. This data is stored in the module 17 at the time of its manufacture in the usual manner and the programming of the memory can not be changed.

The terminal connections are shown symbolically in FIG. 1. Terminal 1 is the input terminal for the signal triggering a tone signal sequence. It is connected to a switch 18 which is actuated periodically, for example every quarter hour, by a clockwork mechanism (not shown). The clockwork mechanism can be driven, for example, by a stepping motor which is controlled by a winding 19 connected to output terminals 11 and 12. A capacitor can also be connected in series with the winding 19.

Two pushbutton switches, 20 and 21, are respectively connected to input terminals 2 and 3 to synchronize the diverse melodies desired at each quarter hour. Switch 20 can be used for synchronization of the melodies produced on the hour, and switch 21 can be used for synchronization of the melodies produced on the quarter hours.

Connected to the terminals 4 and 5 respectively, are selector switches 22 and 23 for selection of the desired melodies. A switch 24 for tone selection is connected to the input terminal 6. This switch co-acts with a sound producing network connected to input terminals 7 and 8. Operation of the switch 24 will activate or mute this network, in dependence upon the position of the switch. This sound-forming network consists, for example, of a resonant network formed by capacitors 25, 26, a resistor 27 and a reactance coil 28.

A quartz oscillator, comprising an oscillating crystal 29 and capacitors 30 and 31, is connected to the output terminals 9 and 10 to generate the required clock signals. It is also possible to connect an RC-oscillator to input terminals 9 and 10, in place of the quartz oscillator, as indicated by resistor 32 and capacitor 33 in FIG. 1*a*. The control pulses for the coil 19 of the clockwork mechanism drive are derived from the clock frequency produced by the oscillator.

A loudspeaker 34 is connected to output terminals 13 and 14. It is also possible, as indicated in FIG. 1*b*, to connect the speaker by way of an amplifier 35 whose amplification factor is variable by means of an adjustable resistor 36.

A battery 37, which furnishes the supply voltage, is connected to input terminals 15 and 16.

Figure 2:
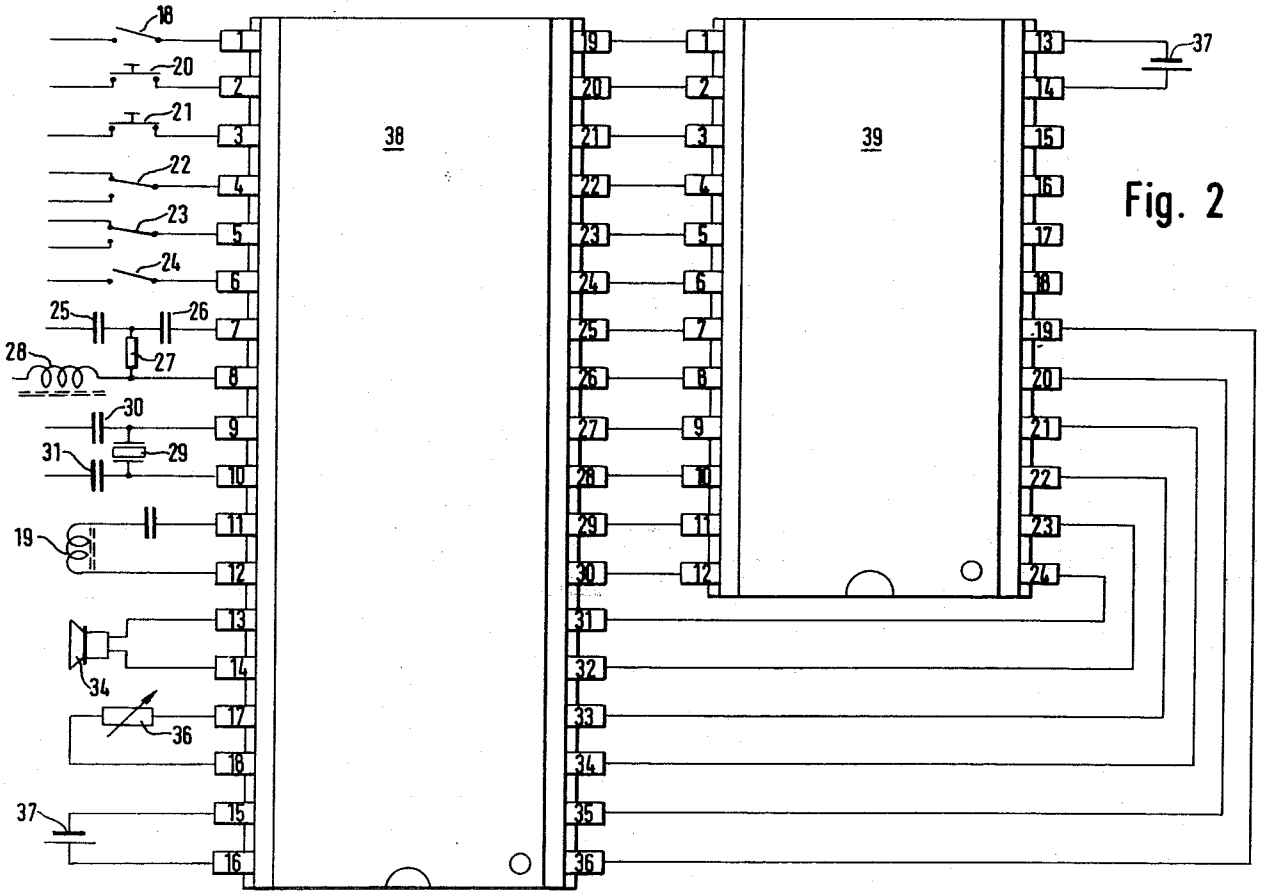
FIG. 2 is a schematic circuit diagram of a clock circuitry with a separate memory circuit system.

The clock circuitry illustrated in FIG. 2 is a modified arrangement of the embodiment of FIG. 1 and consists of two modules 38 and 39. The module 38 is a microprocessor, to which is connected a separate memory circuit system 39. The memory circuit system 39 can be either a ROM, a program mable read-only memory (PROM), or an erasable programmable read-only memory circuit system. A PROM memory is more advantageous than a ROM memory in that it is not pre-programmed by the manufacturer of the integrated circuitry by means of hardwired matrices, and therefore it can be programmed by means of commercially available programming units at the time of clock manufacture or prior to its sale. An EPROM memory has the advantage that it can be erased by ultraviolet light and subsequently be re-programmed.

The circuit systems 38 and 39 are connected with each other by data, address and control bus wires in a manner known to those of ordinary skill in the art. The circuit system 38 corresponds to the chip arrangement 17 described in FIG. 1.

The number of tone frequencies and tone lengths that can be programmed into the clock circuitry will depend on the capacity of the memory units. In the case of the circuit system 17 of FIG. 1 with integrated memory units, the capacity of the memory units will usually be smaller than in the case where a separate, additional memory chip 39 is used. The memory units are programmed in digital form by data representing the tone frequencies and tone lengths of a quarter-hour stroke, a half-hour stroke, a three-quarter-hour stroke and a full hour stroke as well as some additional melodies. Such melodies can be, for example, Bim-Bam, West-minster, Notre-Dame, Trinity, Wittington, Ave-Maria, St. Michael, etc.

Figure 3:
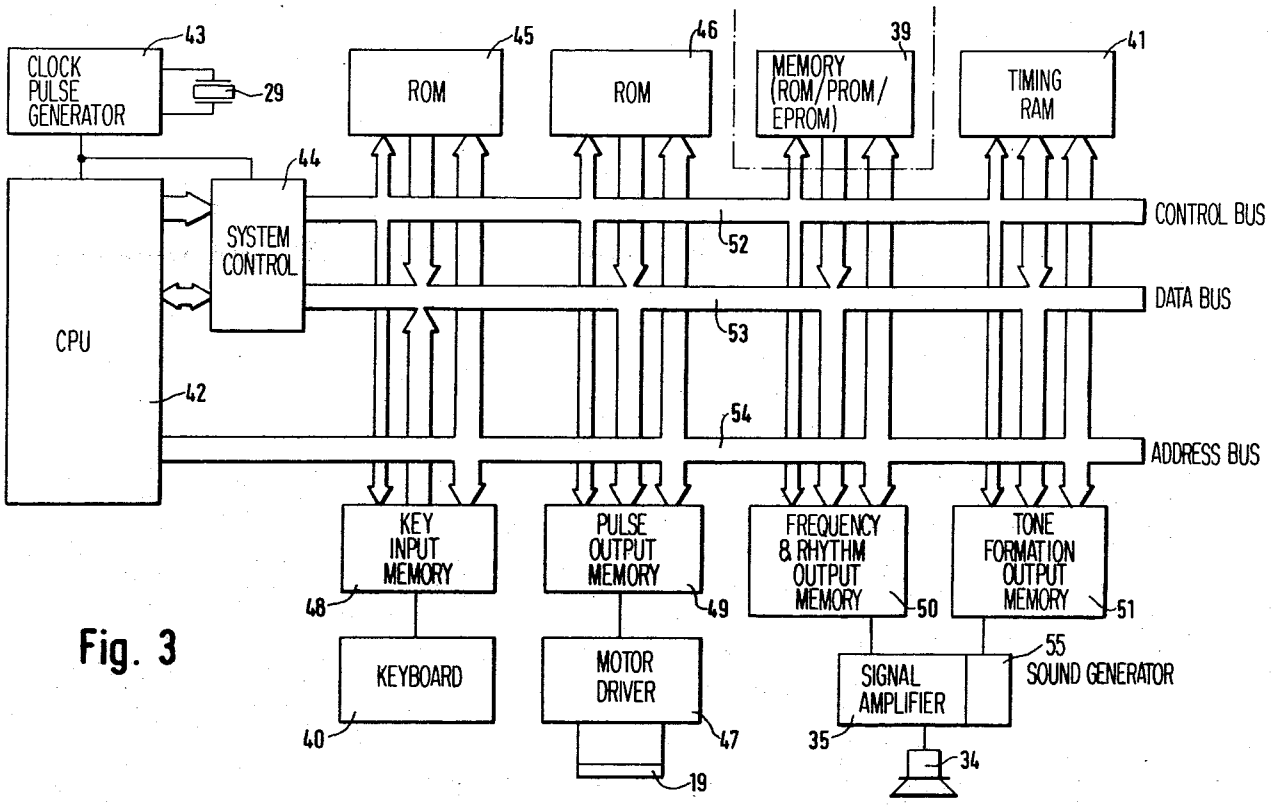
FIG. 3 is a schematic block diagram of clock circuitry.

One example of a circuit arrangement for the chips 17 or 38 of FIGS. 1 or 2 is illustrated in block form in FIG. 3. The input of data is accomplished in this embodiment by way of a keyboard 40, which can be similar to the keyboard of a pocket calculator. Furthermore, the release of pulse sequences is not accomplished by means of a switch 18, but rather by means of a built-in time counter 41 which acts also as a function and data storage and which is formed in a RAM-memory unit. This is a write-read memory unit. FIG. 3 also illustrates the functional units of a microcomputer, specifically the central processing unit (CPU) 42 with the clock pulse generator 43 and system control 44, as well as a ROM data processing control unit 45. A ROM memory unit 46 for the control of tone frequencies and tone lengths can also be included and provides for the selection of various melodies.

Various input or output memory units 48-51 can serve as interfaces between the keyboard 40, a motor drive unit 47 and the signal amplifier 35. The various functional units of the chip can be connected with each other by way of a control bus 52, a data bus 53 and an address bus 54.

In operation, a user selects, by means of the keyboard 40, one specific tone sequence from the stored melodies and the time at which it is to be heard. It is further possible to select the sound volume of the melodies as well as their sound effect, for example with or without vibrato, by way of the keyboard 40. The keyboard is also used to synchronize the time shown by the clock with the actual, correct time.

In place of a motor driven indicator, it is also possible to provide a liquid crystal display (LCD) for indicating time. The clock circuitry can further be designed in such manner that the date will also be shown. It then becomes possible to use the keyboard to select and set specific dates, for example festival days, on which a certain melody is to be heard.

The output memory unit 51 which is used for the formation of sound and which is controlled by the keyboard 40, influences a sound-producing network 55, which can be identical in design with the network shown in FIGS. 1 and 2. The output memory unit 51 controls the output signal by either connecting or disconnecting the sound generator 55 from the signal amplifier.

The clock circuitry can further be designed in a manner known per se to include calculating functions which can be performed by way of the keyboard 40 and display (not shown).

The present invention may be embodied in other specific forms without departing from the spirit or essential characteristics thereof. The presently disclosed embodiments are therefore considered in all respects as illustrative and not restrictive. The scope of the invention is indicated by the appended claims rather than the foregoing description, and all changes which come within the meaning and range of equivalency of the claims are therefore intended to be embraced therein.

What is claimed is:

1. An electronic clock with chimes or an alarm, comprising:

a clockwork mechanism for providing an indication of the time of day;

a memory unit having the sequences of tone frequencies of a plurality of different melodies stored in digital form;

manually actuatable means for selecting one of said stored melodies and the time of day the selected melody is to be played;

program control means for controlling the operation of said clockwork mechanism and for reading the information relating to the sequence of tone frequencies of the selected melody from said memory unit at the selected time of day; and an electro-acoustic transducer for transforming the information read from said memory unit into an audible melody.

2. The electronic clock of claim 1 wherein digital information relating to tone length for each sequence of tone frequencies is also stored in said memory unit.

3. The electronic clock of claim 1 wherein said electronic clock further includes a tone forming network responsive to the data stored in said memory unit and connected in series with said electro-acoustic transducer.

4. The electronic clock of claim 3 wherein said memory unit is incorporated in a single integrated chip which includes circuitry for determining the time and for controlling the time related data recall, said chip having external output terminals for the transmission of signals for influencing the production of a sequence of tone frequencies in accordance with data stored in said memory unit.

5. The electronic clock of claim 3 wherein said memory unit is comprised of a separate integrated chip and is connected to a microprocessor which controls the recall of data from said memory unit and the transmission of signals for influencing the production of a sequence of tone frequencies in accordance with data in said memory unit.

6. The electronic clock of claim 1 wherein said manually actuatable means comprises an input keyboard for providing control information and for enabling one of said stored melodies to be selected.

7. The electronic clock of claim 1 wherein said program control means calls stored sequences of consecutive portions of melodies from said memory unit at quarter hour intervals.

8. The electronic clock of claim 1 wherein said program control means calls a predetermined melody sequence from said memory unit on preselected calendar dates.

9. The electronic clock of claim 1 further including a random access memory which functions to control the time-related recall of stored melody sequences from said memory unit.

* * * * *